United States Patent [19]

Yoshizawa et al.

[11] Patent Number: 4,985,089

[45] **Date of Patent: * Jan. 15, 1991**

[54] FE-BASE SOFT MAGNETIC ALLOY POWDER AND MAGNETIC CORE THEREOF AND METHOD OF PRODUCING SAME

[75] Inventors: Yoshihito Yoshizawa; Kiyotaka Yamauchi, both of Kumagaya, Japan

[73] Assignee: Hitachi Metals, Ltd., Tokyo, Japan

[ * ] Notice: The portion of the term of this patent subsequent to Nov. 21, 2006 has been disclaimed.

[21] Appl. No.: 223,842

[22] Filed: Jul. 25, 1988

[30] Foreign Application Priority Data

Jul. 23, 1987 [JP] Japan ..... 62-183878

[51] Int. Cl.[5] ..... H01F 1/147

[52] U.S. Cl. ..... 148/303; 148/304; 148/306; 148/307; 148/310; 148/311; 420/89

[58] Field of Search ..... 148/304, 306, 303, 307, 148/310, 311; 75/251, 255; 420/83, 89

[56] References Cited

U.S. PATENT DOCUMENTS 4,881,989 11/1989 Yoshizawa et al. ..... 148/307

FOREIGN PATENT DOCUMENTS 69360 6/1981 Japan ..... 148/304
33804 2/1983 Japan ..... 148/304
213832 12/1983 Japan ..... 148/304
52557 3/1985 Japan ..... 148/304
1149459 7/1986 Japan ..... 148/304
179704 8/1987 Japan ..... 148/304

*Primary Examiner*—Theodore Morris
*Assistant Examiner*—George Wyszomierski
*Attorney, Agent, or Firm*—Sughrue, Mion, Zinn, Macpeak &Seas

[57] ABSTRACT

Fe-base soft magnetic alloy powder and dust core having the composition represented by the general formula:

$$(Fe_{1-a}M_a)_{100-x-y-z-\alpha-\beta-\gamma}Cu_xSi_yB_z\text{-}M'_\alpha M''_\beta X_\gamma$$

wherein M is Co and/or Ni, M′ is at least one element selected from the group consisting of Nb, W, Ta, Zr, Hf, Ti and Mo, M″ is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As, and a, x, y, z, $\alpha$, $\beta$ and $\gamma$ respectively satisfy $0 \leqq a \leqq 0.5$, $0.1 \leqq x \leqq 3$, $0 \leqq y \leqq 30$, $0 \leqq z \leqq 25$, $0 \leqq y+z \leqq 35$, $0.1 \leqq \alpha \leqq 30$, $0 \leqq \beta \leqq 10$ and $0 \leqq \gamma \leqq 10$, at least 50% of the alloy structure being fine crystalline particles having an average particle size of 500 Å or less.

15 Claims, 8 Drawing Sheets

200Å

FE-BASE SOFT MAGNETIC ALLOY POWDER AND MAGNETIC CORE THEREOF AND METHOD OF PRODUCING SAME

BACKGROUND OF THE INVENTION

The present invention relates to Fe-base soft magnetic alloy powder having excellent magnetic properties and applications thereof, and more particularly to Fe-base soft magnetic alloy powder having a low magnetostriction, and applications thereof as transformers, choke coils, saturable reactors, etc. and methods of producing them.

Conventionally, magnetic cores for transformers, motors, chokes, noise filters, etc. are made of crystalline materials such as Fe-Si alloys, Permalloy, ferrites, etc. Fe-Si alloys, however, have large specific resistance and their crystal magnetic anisotropy is not zero. Accordingly, they suffer from large core losses at a relatively high frequency. Permalloy also has a high core loss at a high frequency.

Conventionally used widely as magnetic powder materials for high-frequency transformers, saturable reactors, choke coils, etc. are mainly ferrites having such advantages as low eddy current loss.

However, despite the fact that ferrites have small core losses at a high frequency, their magnetic flux densities are at most 5000 G. Accordingly, when they are operated at a large magnetic flux density, they are close to saturation, leading to large core losses.

Recently, transformers operable at a high frequency, such as those for switching regulators are required to be miniaturized. For this purpose, the magnetic flux density in an operating region should be increased. Thus, the increase in a core loss of ferrites may become a serious problem for practical applications.

For the purpose of decreasing a core loss at a high frequency and improving frequency characteristics of permeability, dust cores of crystalline magnetic alloys are conventionally used. The dust cores are prepared by forming fine powder of the magnetic alloys and solidifying it via insulating layers. For such insulating layers, organic materials are used. Such magnetic dust cores are mainly used for chokes, noise filters, etc.

However, since the dust cores made of the conventional crystalline magnetic powder have small permeability, a large number of winding is necessary to achieve sufficient inductance, making it difficult to miniaturize magnetic cores constituted by such dust cores. In addition, since they have large core losses, a lot of heat is generated during their use.

Recently, as an alternative to such conventional magnetic materials, amorphous magnetic alloys having high saturation magnetic flux densities have teen attracting much attention.

These amorphous alloys are essentially composed of Fe, Co or Ni, etc. as a basic element, and at least one of P, C, B, Si, Al, Ge, etc. as a metalloid which can make the resulting alloys amorphous. Further, it is known that there are amorphous alloys composed of Fe, Co or Ni and Ti, Zr, Hf, Nb, etc. without metalloids, which can be produced by a roll method.

However, since amorphous magnetic alloys are tough and difficult to be pulverized, they are generally produced in the form of a thin ribbon and the thin ribbon is laminated or wound to form a magnetic core.

To form a magnetic core from the thin ribbon, it should be formed into a toroidal wound core or cut into a desired shape such as a U-shape or an E-shape and then laminated. However, when a U-shape or E-shape magnetic core is desired, its production is generally difficult.

To eliminate this problem, various methods of producing dust cores by pulverizing an amorphous magnetic alloy and compressing the resulting powder together with a binder were proposed. See, for instance, Japanese Patent Laid-Open Nos. 55-133507, 61-154014, 61-154111, 61-166902, etc. Further, various methods of producing dust cores with high densities by instantaneously applying an impact force to amorphous magnetic alloy powder were proposed. See, for instance, Japanese Patent Laid-Open Nos. 61-288404 and 62-23905.

Amorphous alloys which may be used for such dust cores are mainly classified into two categories: iron-base alloys and cobalt-base alloys. Fe-base amorphous alloys are advantageous in that they are less expensive than Co-base amorphous alloys, but they generally have larger core loss and lower permeability at high frequency than the Co-base amorphous alloys. On the other hand, despite the fact that the Co-base amorphous alloys have small core loss and high permeability at high frequency, their core loss and permeability vary largely as the time passes, posing problems in practical use. Further, since they contain as a main component an expensive cobalt, they are inevitably disadvantageous in terms of cost.

In any case, alloy powder and dust cores having sufficiently high saturation magnetic flux density and other good magnetic properties cannot be obtained from Fe-base or Co-base amorphous alloys.

OBJECT AND SUMMARY OF THE INVENTION

Therefore, an object of the present invention is to provide an Fe-base soft magnetic alloy powder having excellent magnetic characteristics such as a saturation magnetic flux density, etc.

Another object of the present invention is to provide a method of producing such Fe-base soft magnetic alloy powder.

A further object of the present invention is to provide an Fe-base soft magnetic alloy dust core having excellent soft magnetic properties, particularly a high saturation magnetic flux density, a small core loss and a small change of core loss with time, large permeability and other excellent magnetic properties.

A further object of the present invention is to provide a method of producing such an Fe-base soft magnetic alloy dust core.

Intense research in view of the above objects has revealed that the addition of Cu and at least one element selected from the group consisting of Nb, W, Ta, Zr, Hf, Ti and Mo to an Fe-base alloy, and a proper heat treatment of the Fe-base alloy which is once made amorphous can provide an Fe-base soft magnetic alloy, a major part of whose structure is composed of fine crystalline particles, and thus having excellent soft magnetic properties. The present invention is based on these findings.

Thus, the Fe-base soft magnetic alloy powder according to the present invention has the composition represented by the general formula:

$$(Fe_{1-a}M_a)_{100-x-y-z-\alpha-\beta-\gamma}Cu_xSi_yB_zM'_\alpha M''_\beta X_\gamma$$

wherein M is Co and/or Ni, M' is at least one element selected from the group consisting of Nb, W, Ta, Zr, Hf, Ti and Mo, M'' is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As, and a, x, y, z, $\alpha$, $\beta$and $\gamma$respectively satisfy $0<a<0.5$, $0.1<x<3$, $0<y<30$, $0<z<=25$, $0<y+z<35$, $0.1<\alpha<30$ $0<\mu<10$ and $0<\gamma<10$, at least 50% of the alloy structure being fine crystalline particles having an average particle size of 500% or less when measured by their maximum sizes.

Further, the method of producing Fe-base soft magnetic alloy powder according to the present invention comprises the steps of rapidly quenching a melt of the above composition and heat-treating it to generate fine crystalline particles having an average particle size of 500 Å or less which constitute at least 50% of the alloy structure.

The Fe-base soft magnetic alloy dust core according to the present invention is composed of compressed Fe-base soft magnetic alloy powder.

The method of producing an Fe-base soft magnetic alloy dust core according to the present invention which comprises compressing fine powder of the Fe-base soft magnetic alloy together with a binder and/or an electrically insulating material.

BRIEF DESCRIPTION OF THE DRAWINGS

FIG. 2 (b) is a graph showing an X-ray diffraction pattern of the Fe-base soft magnetic alloy of the present invention after heat treatment;

DETAILED DESCRIPTION OF THE INVENTION

Figure 1:
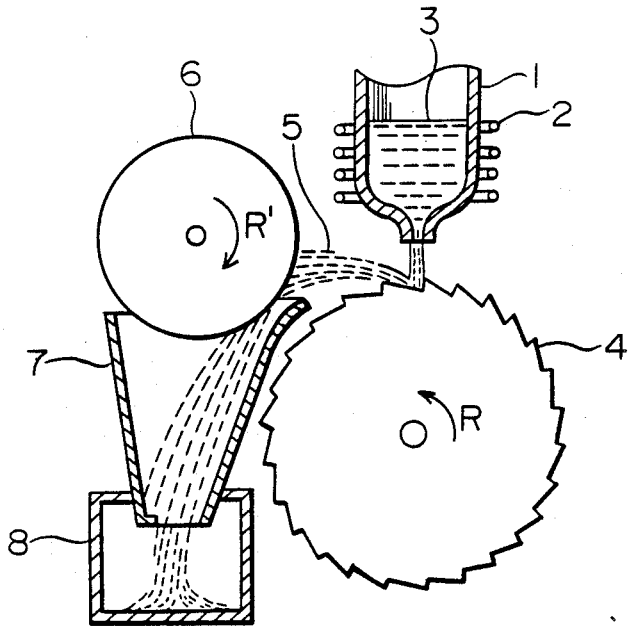
FIG. 1 is a schematic view showing an apparatus for producing the Fe-base alloy powder according to the present invention.

In the Fe-base soft magnetic alloy of the present invention, Fe may be substituted by Co and/or Ni in the range fro 0 to less than 0.5. However, to have good magnetic properties such as a low core loss, the content of Co and/or Ni which is represented by "a" is preferably 0–0.3.

In the present invention, Cu is an indispensable element, and its content "x" is 0.1–3 atomic %. When it is less than 0.1 atomic %, substantially no effect on the reduction of a core loss and on the increase in permeability can be obtained by the addition of Cu. On the other hand, when it exceeds 3 atomic %, the alloy's core loss becomes larger than those containing no Cu, reducing the permeability, too. The preferred content of Cu in the present invention is 0.5–2 atomic %, in which range the core loss is particularly small and the permeability is high.

The reasons why the core loss decreases and the permeability increases by the addition of Cu are not fully clear, but it may be presumed as follows:

Since Cu and Fe have a positive interaction parameter which makes their solubility low, iron atoms and copper atoms tend to gather separately to form clusters when heat-treated, thereby producing compositional fluctuation. This produces a lot of domains likely to be crystallized to provide nuclei for generating fine crystalline particles. These crystalline particles are based on Fe, and since Cu is substantially not soluble in Fe, Cu is ejected from the fine crystalline particles, whereby the Cu content in the vicinity of the crystalline particles becomes high. This presumably suppresses the growth of crystalline particles.

Because of the formation of a large number of nuclei and the suppression of the growth of crystalline particles by the addition of Cu, the crystalline particles are made fine, and this phenomenon is accelerated by the inclusion of Nb, Ta, W' Mo, Zr, Hf, Ti, etc.

Without Nb, Ta, W, Mo, Zr, Hf, Ti, etc., the crystalline particles are not fully made fine and thus the soft magnetic properties of the resulting alloy are poor. Particularly Nb and Mo are effective, and particularly Nb acts to keep the crystalline particles fine, thereby providing excellent soft magnetic properties. And since a fine crystalline phase based on Fe is formed, the Fe-base soft magnetic alloy has smaller magnetostriction than Fe-base amorphous alloys, which means that the Fe-base soft magnetic alloy has smaller magnetic anisotropy due to internal stress-strain, resulting in improved soft magnetic properties.

Without the addition of Cu, the crystalline particles are unlikely to be made fine. Instead, a compound phase is likely to be formed and crystallized, thereby deteriorating the magnetic properties.

Si and B are elements particularly for making fine the alloy structure. The Fe-base soft magnetic alloy is desirably produced by once forming an amorphous alloy with the addition of Si and B, and then forming fine crystalline particles by heat treatment.

The content of Si ("y") and that of B ("z") are $0<y<30$ atomic %, $0<z<25$ atomic %, and $0<+-z<35$ atomic %, because the alloy would have an extremely reduced saturation magnetic flux density if otherwise. When other amorphous-forming elements are contained in small amounts, $y+z$ should be 10–35 atomic % to facilitate the production of an amorphous alloy.

In the present invention, the preferred range of y is 10–25 atomic %, and the preferred range of z is 3–12 atomic %, and the preferred range of $y+z$ is $18\neq28$ atomic %. In these ranges, the Fe-base soft magnetic alloy is provided with a low core loss.

In the present invention, M' acts when added together with Cu to make the precipitated crystalline particles fine. M' is at least one element selected from the group consisting of Nb, W, Ta, Zr, Hf, Ti and Mo. These elements have a function of elevating the crystallization temperature of the alloy, and synergistically with Cu having a function of forming clusters and thus lowering the crystallization temperature, it suppresses the growth of the precipitated crystalline particles, thereby making them fine.

The content of M'(α) is 0.1–30 atomic %. When it is less than 0.1 atomic %, sufficient effect of making crystalline articles fine cannot be obtained, and when it exceeds 30 atomic % an extreme decrease in a saturation magnetic flux density ensues. The preferred content of M' is 2–8 atomic %, in which range particularly excellent soft magnetic properties are obtained. Incidentally, most preferable as ' is Nb and/or Mo, and particularly Nb in terms of magnetic properties. The addition of ' provides the Fe-base soft magnetic alloy with as high permeability as that of the Co-base high-permeability materials.

M", which is at least one element selected from the group consisting of V, Cr, Mn, Al, elements in the platinum group, Sc, Y, rare earth elements, Au, Zn, Sn and Re, may be added for the purposes of improving corrosion resistance and magnetic properties and of adjusting magnetostriction, but its content is at most 10 atomic %. When the content of M" exceeds 10 atomic %, an extremely decrease in a saturation magnetic flux density ensues. A particularly preferred amount of M" is 8 atomic % or less.

Among them, at least one element selected from the group consisting of Ru, Rh" Pd, Os, Ir, Pt, Au, Cr and V is capable of providing the alloy with particularly excellent corrosion resistance and wear resistance.

The alloy of the present invention may contain 10 atomic % or less of at least one element X selected from the group consisting of C, Ge, P, Ga, Sb, In, Be, As. These elements are effective for making amorphous, and when added with Si and B, they help make the alloy amorphous and also are effective for adjusting the magnetostriction and Curie temperature of the alloy. The preferred amount of X is 5 atomic % or less.

In sum, in the Fe-base soft magnetic alloy having the general formula:

$$(Fe_{1-a}M_a)_{100-x-y-z-\alpha-\beta-\gamma}Cu_xSi_yB_zM'_\alpha M''_\beta X_{65},$$

the general ranges of a, x, y, z, α, β- and γ are $0<a<0.5$
$0.1<x<3$
$0<y<30$
$0<z<25$
$0<y+z<35$
$0.1<\alpha<30$
$0<\beta<10$
$0<\gamma<10,$ and the preferred ranges are $0<a<0.3$
$0.5<x<2$
$10<y<25$
$3<z<12$
$18<y+z<28$
$2<<8$
$\beta<8$
$\gamma<5.$ In the Fe base soft magnetic alloy having the above composition according to the present invention, at least 50% of the alloy structure consists of fine crystalline particles. These crystalline particles are based on α-Fe having a bcc structure, in which Si and B, etc. are dissolved. These crystalline particles have an extremely small average particle size of 500 Å or less, and are uniformly distributed in the alloy structure. Incidentally, the average particle size of the crystalline particles is determined by measuring the maximum size of each particle and averaging them. When the average particle size exceeds 500 Å, good soft magnetic properties are not obtained. It is preferably 200 Å or less and particularly 50–200 Å. The remaining portion of the alloy structure other than the fine crystalline particles is mainly amorphous. Even with fine crystalline particles occupying substantially 100% of the alloy structure, the Fe-base soft magnetic alloy of the present invention has sufficiently good magnetic properties.

Incidentally, with respect to inevitable impurities such as N, 0, S, etc., it is to be noted that the inclusion thereof in such amounts as not to deteriorate the desired properties is not regarded as changing the alloy composition suitable for magnetic cores, etc.

Next, the method of producing the Fe-base soft magnetic alloy powder of the present invention will be explained in detail below.

First, a melt of the above composition is rapidly quenched by various methods.

The method comprises rapidly quenching an alloy melt having the above composition to provide amorphous alloy powder and then heat-treating the powder.

The amorphous alloy powder can be produced by a water atomizing method, a gas atomizing method, a spray method, a cavitation method, a spark errosion method, a method of ejecting a melt into a rotating liquid, etc. The amorphous alloy powder is desirably completely amorphous, but it may contain a crystalline phase.

The second method comprises rapidly quenching an alloy melt having the above composition to provide amorphous alloy ribbons, flakes or wires, heat-treating them to make them brittle, pulverizing them, and then heat-treating them to generate fine crystalline particles. Incidentally, the amorphous alloy ribbons, flakes or wires can be produced by a single roll method, a double roll method, a centrifugal quenching method, a method of spinning into a rotating liquid, etc. The first heat treatment is conducted at a temperature between a temperature which is lower than their crystallization temperatures by about 250° C. and their crystallization temperatures for a sufficient period of time for making them brittle, usually for 1–3 hours.

The third method comprises rapidly quenching an alloy melt having the above composition to provide amorphous alloy ribbons, flakes or wires, causing them to absorb a hydrogen gas at a temperature lower than their crystallization temperatures for a sufficient period of time for making them brittle, pulverizing them to power, and then heat-treating the powder. The absorption of a hydrogen gas in the amorphous alloy ribbons, flakes or wires can be achieved by placing them in a pressurized hydrogen gas atmosphere, or by using them as a cathode in an electrolytic both for hydrogen production.

The fourth method comprises rapidly quenching an alloy melt having the above composition to provide brittle amorphous alloy ribbons, flakes or wires, pulverizing them to amorphous alloy powder, and then heat-treating the powder. The brittle amorphous alloy ribbons, flakes or wires can be produced by reducing a cooling rate of the alloy melt, specifically, by slowing the rotation of a roll for quenching the alloy melt or by making the ribbons, flakes or wires thicker, etc.

The fifth method comprises rapidly quenching an alloy melt having the above composition to provide amorphous alloy ribbons, flakes or wires, heat-treating them, and then pulverizing them to powder. When the amorphous alloy ribbons, flakes or wires are heat-treated at a temperature higher than their crystallization temperatures, they are made so brittle that they can easily be pulverized by a ball mill, a vibration mill, etc.

In each of the above methods, the heat treatment is carried out by heating the amorphous alloy in the form of powder, ribbon, flake, wire, etc. in vacuum or in an inert gas atmosphere such as hydrogen, nitrogen, argon, etc. The temperature and time of the heat treatment vary depending upon the composition of the amorphous alloy ribbon and the shape and size of a magnetic core made from the amorphous alloy powder. In general, it is heated at a temperature higher than its crystallization temperature for a sufficient period of time for making it brittle. Specifically, it is preferably 450–700° C. for 5 minutes to 24 hours. When the heat treatment temperature is lower than 450° C., crystallization is unlikely to take place with ease, requiring too much time for the heat treatment. On the other hand, when it exceeds 700° C., coarse crystalline particles tend to be formed, making it difficult to obtain fine crystalline particles. And with respect to the heat treatment time, when it is shorter than 5 minutes, it is difficult to heat the overall worked alloy at uniform temperature, providing uneven magnetic properties, and when it is longer than 24 hours, productivity becomes too low and also the crystalline particles grow excessively, resulting in the deterioration of magnetic properties. The preferred heat treatment conditions are, taking into consideration practicality and uniform temperature control, etc., 500–650° C. for 5 minutes to 6 hours.

It is preferable to cool the alloy powder or the dust core rapidly after heat treatment. For this purpose, the alloy powder or the dust core is taken out of a heat treatment furnace and left to stand in the air or immersed in an oil, etc.

The heat treatment atmosphere is preferably an inert gas atmosphere, but it may be an oxidizing atmosphere such as the air. Cooling may be carried out properly in the air or in a furnace. And the heat treatment may be conducted by a plurality of steps.

The heat treatment can be carried out in a magnetic field to provide the alloy with magnetic anisotropy. The magnetic field need not be applied always during the heat treatment, and it is necessary only when the alloy is at a temperature lower than the Curie temperature Tc thereof. In the present invention, the alloy has an elevated Curie temperature because of crystallization than the amorphous counterpart, and so the heat treatment in a magnetic field can be carried out at temperatures higher than the Curie temperature of the corresponding amorphous alloy. In a case of the heat treatment in a magnetic field, it may be carried out by two or more steps. Also, a rotational magnetic field can be applied during the heat treatment.

Incidentally, the Fe-base soft magnetic alloy of the present invention can be produced by other methods than liquid quenching methods, such as vapor deposition, ion plating, sputtering, etc.

The Fe-base soft magnetic alloy powder according to the present invention may be in the form of a fine plate-like particle having a length less than 100 μm and a uniform thickness. The alloy powder having a particle size less than 4 mesh can be produced from the amorphous alloy ribbons and flakes in the methods 2–5. Such powder can be bonded with a resin to form electromagnetic wave-shielding sheets, etc.

With respect to substantially sphere powder, it can be produced by a spark errosion method, by ejecting an alloy melt onto a rotating slanted disc to form sphere melt drops which are then thrown into a rotating water, or by ejecting an alloy melt into a rotating coolant. Such sphere powder usually has a particle size of 200 μm or less. With respect to powder of irregular shape, it can be produced by a water atomizing method, etc. The irregular powder particles usually have a maximum size of 2 mm or less.

In any case, both sphere powder and irregular powder may be heat-treated under the conditions as described above.

The Fe-base soft magnetic alloy powder heat-treated according to the present invention may be plated with Cu, Cr, Ni, Au, etc., or coated with $SiO_2$, glass, an epoxy resin, etc. to improve its corrosion resistance or to form an insulating layer. Alternatively, it may be further heat-treated to form an oxide layer or a nitride layer thereon.

Next, the Fe-base soft magnetic alloy dust core according to the present invention will be explained.

The amorphous alloy powder as a starting material for the dust core may contain crystal phases, but the alloy structure is preferably amorphous to make sure the formation of uniform fine crystalline particles by a subsequent heat treatment.

This amorphous alloy powder is compressed by a press, etc. to form a dust core. In this process, a binder such as a phenol resin, an epoxy resin, etc. is added. If a heat treatment is to be conducted after the compression process, a heat-resistant binder such as an inorganic varnish is desirable.

When the dust core is produced without using a binder, the amorphous alloy powder is compressed at a temperature near its crystallization temperature for utilizing the deformation cf the alloy by a viscous flow. Further a so-called explosion molding can be used to form a dust core.

When the dust core is to be used for electric parts, insulating layers are desirably provided among the powder particles to decrease the eddy current loss of the resulting dust core. For this purpose, the surface of the amorphous alloy powder is oxidized or coated with a water glass, metal alkoxide, ceramic ultra-fine powder, etc., and then the alloy powder is compressed.

A heat treatment can be conducted on the amorphous alloy in the form of powder. However, except that the alloy has no magnetostriction, the heat treatment is desirably conducted after it is formed into a dust core. The heat treatment conditions are as described above.

The present invention will be explained in detail by the following Examples, without intention of restricting the scope of the present invention.

EXAMPLE 1

A melt having the composition (by atomic %) of 1% Cu, 16.5% Si, 6% B, 3% Nb and balance (73.5%) substantially Fe was formed into a ribbon of 5 mm in width and 20 μm in thickness by a single roll method. The X-ray diffraction of this ribbon showed a halo pattern peculiar to an amorphous alloy as shown in FIG. 2(a).

The amorphous alloy ribbon thus formed was heat-treated in a furnace filled with a nitrogen gas at 510° C. for 1 hour, cooled to room temperature and then pulverized by a vibration mill for 1 hour. The resulting powder was mostly composed of particles of 200 mesh or smaller FIG. 2(b) shows an X-ray diffraction of the heat-treated powder, and FIG. 3 shows a transmission electron photomicrograph (magnification: 300,000) of the heat-treated powder. It was confirmed by the X-ray diffraction and the transmission electron photomicrograph that the heat-treated alloy powder had crystalline particles, and that the crystalline particles had a particle size of about 100–200 Å. The X-ray diffraction shows that the crystalline particles were composed of an Fe solid solution having a bcc structure in which Si, etc. were dissolved.

Next, this Fe-base soft magnetic alloy powder was measured with respect to magnetic properties by a vibration-type magnetometer (VSM). As a result, its saturation magnetic flux density Bs was 12.0 kG, and its coercive force was 0.018 Oe, meaning that it had excellent soft magnetic properties.

EXAMPLE 2

An amorphous alloy ribbon having the composition of $Fe_{73.5}Cu_1Nb_3Si_{17.5}B_5$ with a thickness of 30 μm and a width of 3 mm was produced by a double roll method, and it was heat-treated in a furnace filled with a nitrogen gas at 420° C. for 1 hour. After cooling down to room temperature, it was pulverized by a vibration mill for 2 hours. The resulting powder was mostly composed of particles of 200 mesh or smaller.

The powder thus formed showed a halo pattern in an X-ray diffraction, which is peculiar to an amorphous alloy. The crystallization temperature of the alloy powder was 495° C. when measured at a heating rate of 10° C./min. Next, this powder was heat-treated at 510° C. for 1 hour in a furnace and then cooled to room temperature at a cooling rate of 5° C./min.

It was observed by an X-ray diffraction measurement that the heat-treated powder showed peaks assignable to crystals as in Example 1. The transmission election microscopic observation showed that most of the alloy structure consisted of fine crystalline particles having a particle size of 100–200 Å.

Next, this powder was measured with respect to magnetic properties by a vibration-type magnetometer (VSM). As a result, its saturation magnetic flux density Bs was 11.9 kG and its Hc was 0.021 Oe.

EXAMPLE 3

An amorphous alloy ribbon having the composition of $Fe_{71.5}Cu_1Nb_5Si15.5B7$ with a thickness of 30 μm and a width of 15 mm was produced by a single roll method. The ribbon was brittle. It was pulverized by a ball mill for 5 hours. The resulting powder was mostly composed of particles of 10 mesh or smaller. The crystallization temperature of the alloy powder was 534° C. when measured at a heating rate of 10° C./min.

Next, this powder was heated to 570° C. in an $N_2$ gas atmosphere at a heating rate of 5° C./min, kept at 570° C. for 1 hour and then cooled to room temperature at a cooling rate of 3° C./min.

It was observed by an X-ray diffraction measurement and a transmission electron microscopy that most of the alloy structure consisted of fine crystalline particles.

Next, this powder was measured with respect to magnetic properties by a vibration-type magnetometer (VSM, As a result its saturation magnetic flux density Bs was 10.7 kG and its Hc was 0.012 Oe.

EXAMPLE 4

An alloy powder having the composition of $Fe_{73.5}Cu_1$ $Nb_3Si12.5B10$ was produced by a water atomizing method, and it was classified by a 350-mesh sieve. The powder thus formed showed a halo pattern in an X-ray diffraction, which is peculiar to an amorphous alloy. The crystallization temperature of the alloy powder was 500° C. when measured at a heating rate of 10° C./mi.

Next, this powder was heat-treated in an Ar gas atmosphere at 550° C. for 1 hour and then rapidly cooled to room temperature in the air. It was observed by an X-ray diffraction measurement that the heat-treated powder showed peaks assignable to crystals as in Example 1.

Next, this powder was measured with respect to magnetic properties by a vibration-type magnetometer (VSM). As a result, its saturation magnetic flux density Bs was 12.8 kG and its Hc was 0.021 Oe.

EXAMPLE 5

Amorphous alloy flakes having the composition of $Fe_{71.5}Cu_1Mo_5Si13.5B_9$ with a thickness of about 25 μm were produced by a cavitation method, and they were heated at 420° C. for 1 hour in vacuum. After cooling down to room temperature, they were pulverized by a vibration mill for 1 hour. The resulting powder was mostly composed of particles of 200 mesh or smaller. The crystallization temperature of the alloy powder was 520° C. when measured at a heating rate of 10° C./min.

Next, this powder was heated to 570° C. at a heating rate of 20° C./min, kept at 570° C. for 1 hour, and then cooled to room temperature at a cooling rate of 5° C./min.

It was observed by an X-ray diffraction measurement that the heat-treated powder showed peaks assignable to crystals as in Example 1.

Next, this powder was measured with respect to magnetic properties by a vibration-type magnetometer (VSM). As a result, its saturation magnetic flux density Bs was 11.1 kG and its Hc was 0.014 Oe.

EXAMPLE 6

An amorphous alloy ribbon having the composition of $(Fe_{0.99}Ni_{0.01})_{73.5}Cu_1Nb_3Si_{13.5}B_9$ with a thickness of 20 μm and a width of 10 mm was produced by a single roll method. It was pulverized at room temperature under hydrogen pressure of 155 kg/mm$^2$ for 4 hours. The resulting powder had a particle size distribution of 100–200 mesh=82, 200–325 mesh=14% and over 325 mesh=4%. After removing the hydrogen pressure, it did not contain hydrogen. The crystallization temperature of the resulting alloy powder was 495° C. when measured at a heating rate of 10° C./min.

Next, this powder was heated to 530° C. at a heating rate of 15° C./min, kept at 530° C. for 1 hour and then cooled to room temperature at a cooling rate of 2.5° C./min.

The heat-treated powder had fine crystalline particles mainly composed of Fe as in Example 1.

EXAMPLE 7

Thin amorphous alloy ribbons having the compositions as shown in Table 1 were prepared by a single roll method, and each of the ribbons was heat-treated at 440° C. for 1 hour and then pulverized by a vibration mill. After that, each powder was heat-treated by heating at a temperature higher than its crystallization temperature by 50° C. for 1 hour and then cooling it to room temperature.

The resulting powder, mostly 200 mesh or smaller, had fine crystalline particles as in Example 1. For each powder, a saturation magnetic flux density Bs and a coercive force Hc were measured. Incidentally, for each powder in an amorphous state (before heat treatment), its crystallization temperature Tx was also measured. The results are shown in Table 1.

TABLE 1

| No. | Composition (at %) | Bs (kG) | Hc (Oe) | Tx (°C.) |
|---|---|---|---|---|
| 1 | $Fe_{74}Cu_{0.5}Si_{13.5}B_9Nb_3$ | 12.4 | 0.018 | 507 |
| 2 | $Fe_{74}Cu_1Si_{13}B_9Nb_3$ | 14.6 | 0.060 | 433 |
| 3 | $Fe_{77}Cu_1Si_{10}B_9Nb_3$ | 14.3 | 0.028 | 453 |
| 4 | $Fe_{73.5}Cu_1Si_{17.5}B_5Ta_3$ | 10.5 | 0.018 | 515 |
| 5 | $Fe_{74}Cu_1Si_{14}B_8W_3$ | 12.1 | 0.026 | 480 |
| 6 | $Fe_{73}Cu_2Si_{13.5}B_{8.5}Hf_3$ | 11.6 | 0.032 | 520 |
| 7 | $Fe_{72}Cu_1Si_{14}B_8Zr_5$ | 11.7 | 0.033 | 550 |
| 8 | $Fe_{73}Cu_{1.5}Si_{13.5}B_9Mo_3$ | 12.1 | 0.018 | 493 |
| 9 | $(Fe_{0.959}Co_{0.041})_{73.5}Cu_1Si_{13.5}B_9Nb_3$ | 13.0 | 0.018 | 491 |
| 10 | $Fe_{70.5}Cu_1Si_{20.5}B_5Nb_3$ | 10.8 | 0.030 | 496 |
| 11 | $Fe_{71.5}Cu_1Si_{13.5}B_9Ti_5$ | 11.3 | 0.040 | 480 |
| 12 | $Fe_{69.5}Cu_1Si_{13.5}B_9Nb_7$ | 9.5 | 0.020 | 560 |

EXAMPLE 8

Amorphous alloy ribbons having the compositions shown in Table 2 were produced by a single roll method. Next, each of these amorphous alloy ribbons was heat-treated at 430° C. for 1 hour and then pulverized by a vibration mill. Subsequently, the resulting powder was heated at a temperature higher than its crystallization temperature by 20° C. for 1 hour while applying a magnetic field of 5000 Oe and then cooled to room temperature.

The resulting powder, mostly 200 mesh or smaller, had fine crystalline particles in its alloy structure as in Example 1. For each powder, a saturation magnetic flux density Bs and a coercive force Hc were measured. Incidentally, for each powder in an amorphous state (before heat treatment), its crystallization temperature Tx was also measured. The results are shown in Table 2.

TABLE 2

| No. | Composition (at %) | Bs (kG) | Hc (Oe) | Tx (°C.) |
|---|---|---|---|---|
| 1 | $Fe_{71.5}Cu_1Nb_3Si_{13.5}B_6C_5$ | 13.0 | 0.068 | 496 |
| 2 | $Fe_{70.5}Cu_1Nb_3Si_{13.5}B_9Al_3$ | 11.5 | 0.019 | 487 |
| 3 | $Fe_{68.5}Cu_1Nb_{10}Si_{13.5}B_7$ | 7.4 | 0.033 | 523 |
| 4 | $Fe_{71.5}Cu_1Nb_3Si_{13.5}B_9Al_2$ | 12.5 | 0.040 | 470 |
| 5 | $Fe_{68.5}Cu_1Nb_1Si_{13.5}B_9V_7$ | 10.5 | 0.038 | 510 |
| 6 | $Fe_{70.5}Cu_1Nb_5Si_{15.5}B_7Cr_1$ | 10.2 | 0.017 | 520 |
| 7 | $Fe_{72.5}Cu_1Nb_3Si_{17.5}B_5Ge_1$ | 11.7 | 0.027 | 496 |
| 8 | $Fe_{72.5}Cu_1Mo_3Si_{13.5}B_9Cr_1$ | 11.7 | 0.023 | 497 |
| 9 | $Fe_{70}Cu_1Nb_3Si_{15}B_{10}Ga_1$ | 11.4 | 0.029 | 485 |

EXAMPLE 9

Amorphous alloy powder of $Fe_{73.5}Cu_1Nb3Si15.5B_7$ was produced by an apparatus shown in FIG. 1. In FIG. 1, the apparatus comprises a nozzle 1 surrounded by a heater 2 for containing an alloy melt 3, a serrated roll 4 rotating in the direction shown by R, a cooling roll 6 rotating in the direction shown by R', a guide 7 and a collector 8. The alloy melt 3 was ejected from the nozzle 1 onto the serrated roll 4 to divide it into small droplets 5, which were then caused to collide with the cooling roll 6. When brought into contact with the cooling roll 6' the melt droplets 5 were rapidly quenched to amorphous alloy powder, which was then collected.

The resulting powder had an alloy structure in which fine crystalline particles were dispersed as in Example 1.

Next, this powder was mixed with a polyethylene chlolide resin in a ratio of 62:38 by volume to form a composite sheet of 1.0 mm in thickness. This sheet was measured with respect to electromagnetic wave-shielding characteristics. As a result, it was confirmed that it had a shielding effect of 85 dB at 100kHz.

EXAMPLE 10

A melt having the composition (by atomic %) of 1% Cu, 15Si, 9% B, 3% Nb, 1% Cr and balance substantially Fe was formed into a ribbon of 20 mm in width and 18 μm in thickness by a single roll method. The X-ray diffraction of this ribbon showed a halo pattern peculiar to an amorphous alloy. Its transmission electron photomicrograph (magnification: 300,000) was taken. It was confirmed by the X-ray diffraction and the transmission electron photomicrograph that the ribbon was almost completely amorphous.

The amorphous alloy ribbon was heat-treated in a nitrogen gas atmosphere at 300° C. for 30 minutes, cooled to room temperature and then pulverized by a vibration mill to provide powder of 48 mesh or smaller. The scanning electron microscopic (SEM) observation showed that the resulting powder was mostly composed of flaky particles.

Figure 2:
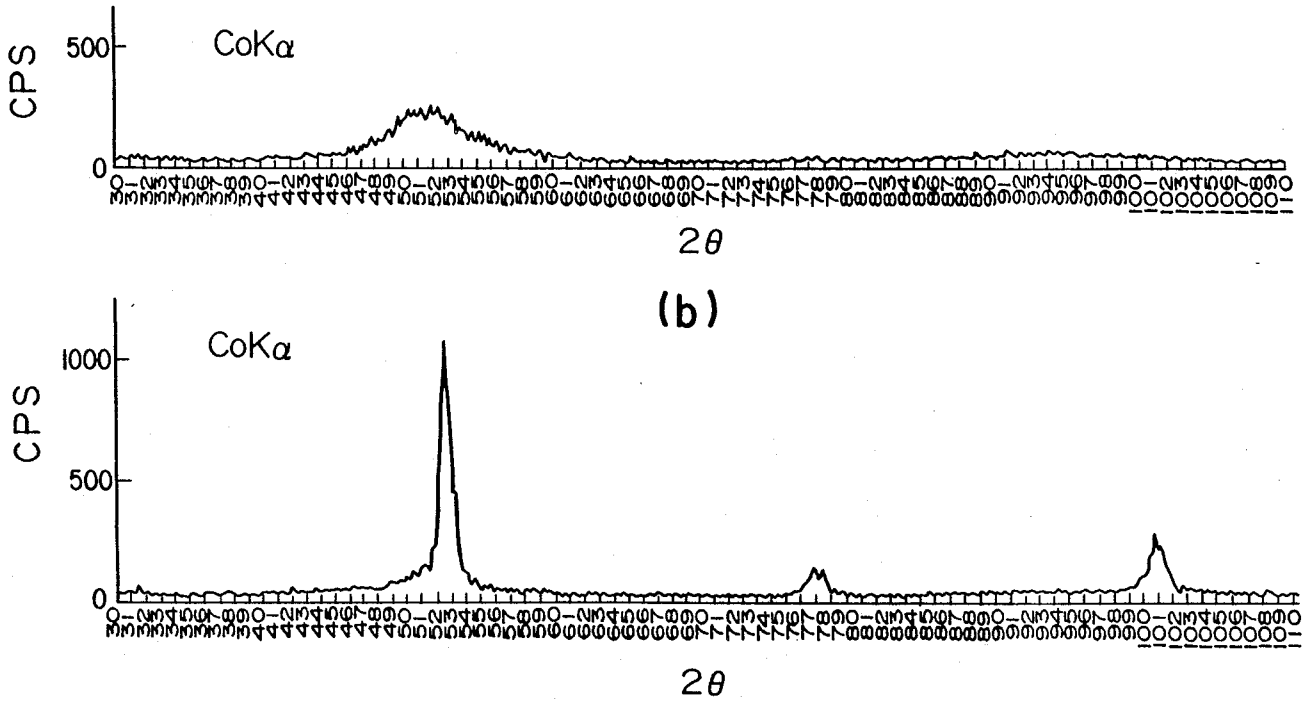
FIG. 2 (a) is a graph showing an X-ray diffraction pattern of the Fe-base alloy powder of Example 1 before heat treatment.
Figure 3:
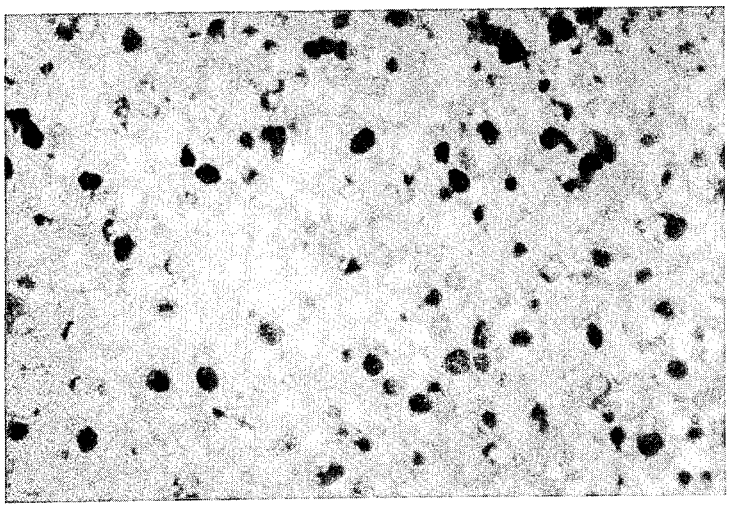
FIG. 3 is a transmission electron photomicrograph (magnification: 300,000) of the Fe-base soft magnetic alloy powder of Example 1 after heat treatment.

As a result of an X-ray diffraction of the heat-treated powder, a halo pattern as in FIG. 2 (a) was observed. Thus, it was confirmed that the powder was substantially amorphous at this stage.

The powder was then mixed with 7 wt% of a heat-resistant inorganic varnish (modified alkyl silicate) as a binder and subjected to pressing at about 250° C. to produce a dust core of 20 mm in outer diameter, 12 mm in inner diameter and 6 mm in thickness.

This core was heat-treated at 550° C. for 1 hour in a nitrogen gas atmosphere and then slowly cooled. Similarly, the above amorphous alloy powder was heat-treated under the same conditions. Both of them were measured by X-ray diffraction. Thus, crystal peaks as in FIG. 2 (b) were observed for both of them. Further, by a transmission electron microscopic observation (×300,000), it was confirmed that most of the alloy structures after heat treatment were composed of fine crystalline particles having an average particle size of about The alloy of the present invention containing both Cu and Nb contained substantially sphere crystalline particles whose average particle size was as small as about 100Å. It was presumed from an X-ray diffraction pattern and a transmission electron microscopy that these crystalline particles were an α-Fe solid solution in which Si, B, etc. were dissolved. When Cu was not contained, the crystalline particles became larger. Thus, it was confirmed that the addition of Cu and Nb extremely affected the size and shape of crystalline particles dispersed in the alloy structure.

Next, the dust cores before and after heat treatment were measured with respect to a core loss $W_{2/100}$ at a maximum wave height of a magnetic flux density Bm=2kG and a frequency of 100kHz. As a result, the core loss was $7500_{mW/cc}$ for the dust core before heat treatment and $530_{mW/cc}$ for that after heat treatment. Thus, it has been verified that the heat treatment of the present invention generates fine crystalline particles uniformly in the alloy structure, leading to remarkable decrease in a core loss.

EXAMPLE 11

Fe-base amorphous alloy dust cores having the compositions as shown in Table 3 were prepared under the same conditions as in Example 10. The resulting alloys were classified into 2 groups, and those in one group were subjected to the same heat treatment as in Example 11, and those in the other group were subjected to a conventional heat treatment (400° C.×1 hour) to keep an amorphous state. They were then measured with respect to core loss W2/100k at 100kHz and 2kG. The results are shown in Table 3.

TABLE 3

| No. | Composition (at %) | Heat Treatment of Present Invention Core Loss $W_{2/100K}$ (mW/cc) | Conventional Heat Treatment Core Loss $W_{2/100K}$ (mW/cc) |
|---|---|---|---|
| 1 | $Fe_{71}Cu_1Si_{15}B_9Nb_3Ti_1$ | 1080 | 3800 |
| 2 | $Fe_{69}Cu_1Si_{15}B_9W_5V_1$ | 1120 | 3900 |
| 3 | $Fe_{69}Cu_1Si_{16}B_8Mo_5Mn_1$ | 1100 | 3400 |
| 4 | $Fe_{69}Cu_1Si_{17}B_7Nb_5Ru_1$ | 1090 | 3300 |
| 5 | $Fe_{71}Cu_1Si_{14}B_{10}Ta_3Rh_1$ | 1260 | 4100 |
| 6 | $Fe_{72}Cu_1Si_{14}B_9Zr_3Pd_1$ | 1350 | 4000 |
| 7 | $Fe_{72.5}Cu_{0.5}Si_{14}B_9Hf_3Ir_1$ | 1410 | 4600 |
| 8 | $Fe_{70}Cu_2Si_{16}B_8Nb_3Pt_1$ | 1080 | 3100 |
| 9 | $Fe_{68.5}Cu_{1.5}Si_{15}B_9Nb_5Au_1$ | 1130 | 3700 |
| 10 | $Fe_{71.5}Cu_{0.5}Si_{15}B_9Nb_3Zn_1$ | 1150 | 3500 |
| 11 | $Fe_{69.5}Cu_{1.5}Si_{15}B_9Nb_3Mo_1Sn_1$ | 1210 | 3000 |
| 12 | $Fe_{68.5}Cu_{2.5}Si_{15}B_9Nb_3Ta_1Re_1$ | 1680 | 5600 |
| 13 | $Fe_{70}Cu_1Si_{15}B_9Nb_3Zr_1Al_1$ | 1170 | 5100 |
| 14 | $Fe_{70}Cu_1Si_{15}B_9Nb_3Hf_1Sc_1$ | 1110 | 5100 |
| 15 | $Fe_{70}Cu_1Si_{15}B_9Hf_3Zr_1Y_1$ | 1720 | 4300 |
| 16 | $Fe_{71}Cu_1Si_{15}B_9Nb_3La_1$ | 2010 | 6000 |
| 17 | $Fe_{67}Cu_1Si_{17}B_9Mo_5Ce_1$ | 1800 | 5200 |
| 18 | $Fe_{67}Cu_1Si_{17}B_9W_5Pr_1$ | 1650 | 5700 |
| 19 | $Fe_{67}Cu_1Si_{17}B_9Ta_5Nd_1$ | 2140 | 5400 |
| 20 | $Fe_{67}Cu_1Si_{17}B_9Zr_5Sm_1$ | 2060 | 5000 |
| 21 | $Fe_{67}Cu_1Si_{16}B_{10}Hf_5Eu_1$ | 2050 | 5600 |
| 22 | $Fe_{68}Cu_1Si_{18}B_9Nb_3Gd_1$ | 2050 | 4900 |
| 23 | $Fe_{68}Cu_1Si_{19}B_8Nb_3Tb_1$ | 1810 | 4700 |
| 24 | $Fe_{72}Cu_1Si_{14}B_9Nb_3Dy_1$ | 1660 | 5300 |
| 25 | $Fe_{72}Cu_1Si_{14}B_9Nb_3Ho_1$ | 1790 | 5100 |
| 26 | $Fe_{71}Cu_1Si_{14}B_9Nb_3Cr_1Ti_1$ | 1100 | 4000 |
| 27 | $(Fe_{0.95}Co_{0.05})_{72}Cu_1Si_{14}B_9Nb_3Cr_1$ | 990 | 3600 |
| 28 | $(Fe_{0.95}Co_{0.05})_{72}Cu_1Si_{14}B_9Ta_3Ru_1$ | 1180 | 4200 |
| 29 | $(Fe_{0.9}Co_{0.1})_{72}Cu_1Si_{14}B_9Ta_3Mn_1$ | 1200 | 5000 |
| 30 | $(Fe_{0.99}Ni_{0.05})_{72}Cu_1Si_{14}B_9Ta_3Ru_1$ | 1160 | 3800 |
| 31 | $(Fe_{0.95}Ni_{0.05})_{71}Cu_1Si_{14}B_9Ta_3Cr_1Ru_1$ | 1100 | 4400 |
| 32 | $(Fe_{0.90}Ni_{0.1})_{68}Cu_1Si_{15}B_9W_5Ti_1Ru_1$ | 1250 | 4800 |
| 33 | $(Fe_{0.95}Co_{0.03}Ni_{0.02})_{69.5}Cu_1Si_{13.5}B_9W_5Cr_1Rh_1$ | 1230 | 4100 |
| 34 | $(Fe_{0.98}Co_{0.01}Ni_{0.01})_{67}Cu_1Si_{15}B_9W_5Ru_3$ | 1140 | 3200 |

Table 3 shows that the heat treatment of the present invention can generate fine crystalline particles uniformly in the amorphous alloy structure, thereby decreasing the alloy's

EXAMPLE 12

Each of amorphous alloy dust cores having the composition of $Fe_{73-x}Cu_xNb_3Si_{14}B_9Cr_1(0<x<3.5)$ was produced in the same manner as in Example 10, and heat-treated at the following optimum heat treatment temperature for one hour, and then measured with respect to a core loss $W_{2/100k}$ at a wave height of magnetic flux density Bm=2kG and a frequency f=100kHz.

| X (atomic %) | Heat Treatment Temperature (°C.) |
|---|---|
| 0 | 510 |
| 0.05 | 515 |
| 0.1 | 530 |
| 0.5 | 550 |
| 1.0 | 570 |
| 1.5 | 570 |
| 2.0 | 560 |
| 2.5 | 540 |
| 3.0 | 510 |
| 3.2 | 500 |
| 3.5 | 490 |

Figure 4:
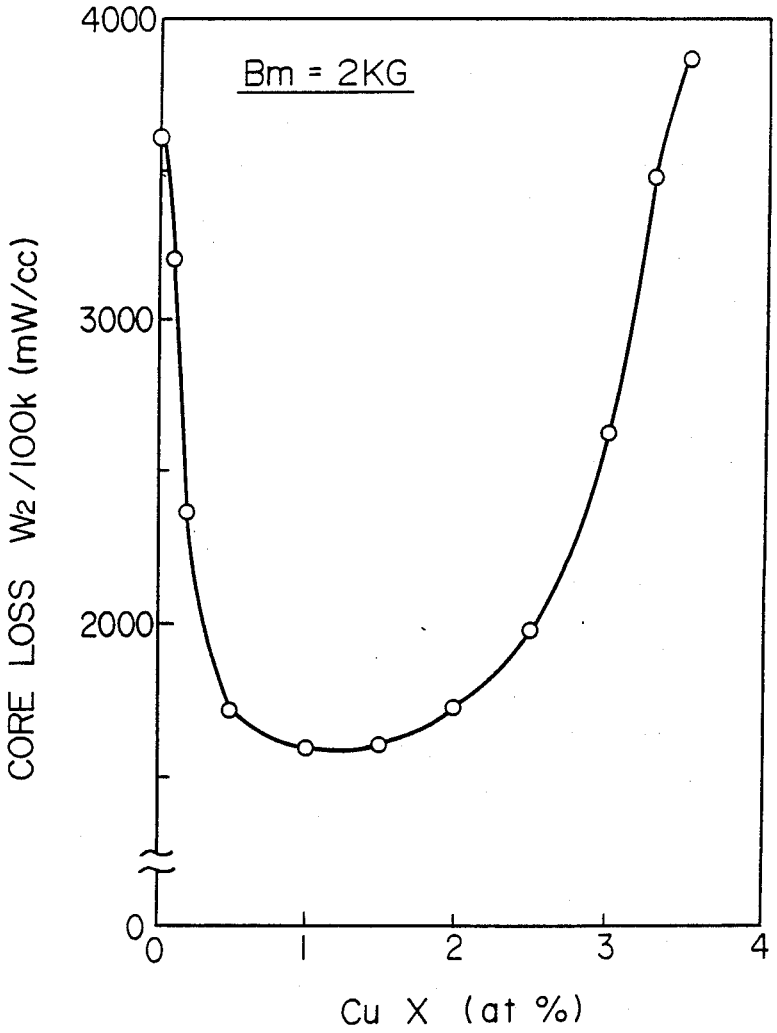
FIG. 4 is a graph showing the relations between Cu content (x) and a core loss $W_{2/100k}$ with respect to the Fe-base soft magnetic alloy of Example 13.

The relations between the content x of Cu (atomic %) and the core loss W2/100k are shown in FIG. 4. It is clear from FIG. 4 that the core loss decreases as the Cu content x increases from 0, but that when it exceeds about 3 atomic %, the core loss becomes as large as that of alloys containing no Cu. When x is in the range of 0.1–3 atomic %, the core loss is sufficiently small. Particularly desirable range of x appears to be 0.5–2 atomic %.

EXAMPLE 13

Each of amorphous alloy dust cores having the composition of Fe75.5-α-$Cu_1Si_{13}B_{9.5}$' $_{\alpha}Ti_1$(' =Nb, W, Ta or Mo) was produced in the same manner as in Example 10, heat-treated at the following optimum heat treatment temperature for one hour, and then measured with respect to a core loss $W_{2/100k}$.

| α (atomic %) | Heat Treatment Temperature (°C.) |
|---|---|
| 0 | 410 |
| 0.1 | 420 |
| 0.2 | 425 |
| 1.0 | 445 |
| 2.0 | 500 |
| 3.0 | 550 |
| 5.0 | 580 |
| 7.0 | 590 |
| 8.0 | 600 |
| 10.0 | 600 |
| 11.0 | 605 |

Figure 5:
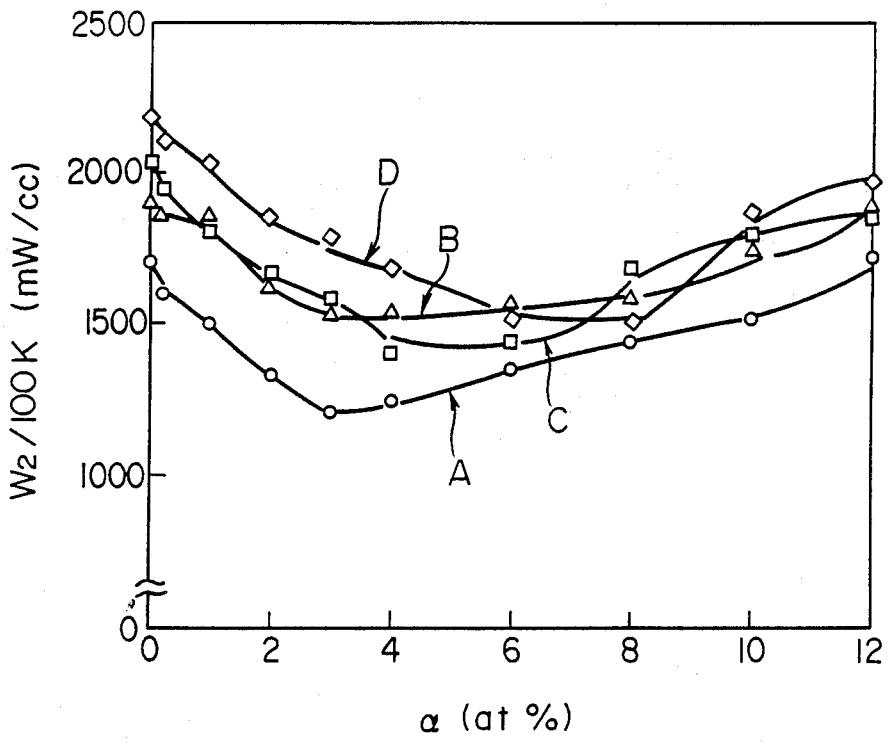
FIG. 5 is a graph showing the relations between M' content (e) and a core loss $W_{2/100k}$ with respect to the Fe-base soft magnetic alloy of Example 14.

The results are shown in FIG. 5, in which graphs A, B, C and D show the alloys in which ' are Nb, W, Ta and Mo, respectively. As is clear from FIG. 5, the core loss is sufficiently small when the amount e of ' is in the range of 0.1–10 atomic %. And particularly when ' is Nb, the core loss was extremely low. A particularly desired range of α is $2<\alpha<8$.

EXAMPLE 14

Alloy powder having the composition of $Fe_{72}Cu_1Si_{13.5}B9.5Nb_3Ru_1$ was produced by a water atomizing method and classified by a sieve to obtain powder of 48 mesh or smaller. As a result of X-ray diffraction measurement, a halo pattern was observed. Thus, it was confirmed that the alloy powder was almost completely amorphous. The powder was mixed with 0.7% water glass (JIS No. 3) and stirred sufficiently. After that, it was dried at 180° C. for 2 hours.

This powder was solidified to a bulk by using an impact compression method. Thus, a toroidal (doughnut-shaped) magnetic core of 20 mm in outer diameter, 12 mm in inner diameter and 5 mm in thickness was obtained. Incidentally, the solidification of the alloy powder was conducted by using an impact gun at impact pressure of 7 GPa to provide a core having a density of 97%.

After heat treatment at 550° C. for 1 hour, it was measured with respect to a saturation magnetic flux density Bs, effective permeability $\mu e_{1k}$ at 1kHz and a core loss W at 1 kG and 10kHz. For comparison, effective permeability was also measured for an Fe-base amorphous alloy dust core ($Fe_{78}B_{13}Si_9$) a Co-base amorphous alloy dust core ($Co_{70.3}Fe_{4.7}Si_{15}B_{10}$) and an Mo Permalloy dust core. The results are shown in Table 4. Incidentally, the Fe-base amorphous alloy dust core was produced in the same manner as the $Fe_{72}Cu_1Si_{13.5}B_{9.5}Nb3Ru_1$ dust core except for heat treatment. The Fe-base amorphous alloy dust core was annealed at 400° C. for 2 hours, which could keep the amorphous state of the alloy.

TABLE 4

| No.* | Composition (at %) | Bs (kG) | μ e1k | $W_{1/10k}$ (W/kg) |
|---|---|---|---|---|
| 1 | $Fe_{72}Cu_1Si_{13.5}B_{9.5}Nb_3Ru_1$ | 12.0 | 1800 | 48 |
| 2 | $Fe_{78}B_{13}Si_9$ | 15.1 | 900 | 100 |
| 3 | $Co_{70.3}Fe_{4.71}Si_{15}B_{10}$ | 7.8 | 1500 | 50 |

TABLE 4-continued

| No.* | Composition (at %) | Bs (kG) | μ e1k | $W_{1/10k}$ (W/kg) |
|---|---|---|---|---|
| 4 | Mo Permalloy | 7.2 | 800 | 90 |

Note
*Sample Nos. 2–4 are Comparative Examples.

It is clear from Table 4 that the Fe-base soft magnetic alloy dust core of the present invention has a higher saturation magnetic flux density than those of the Co-base amorphous alloy dust core and the Permalloy dust core, and that it also has higher permeability and a smaller core loss than those of the Fe-base amorphous alloy dust core. Therefore, the Fe-base soft magnetic alloy dust core of the present invention is suitable for choke coils, etc.

EXAMPLE 15

Amorphous alloy ribbons having the compositions shown in Table 5 were treated in the same manner as in Example 1 to provide Fe-base soft magnetic alloy dust cores. Table 5 shows the corrosion resistance and core loss variation ΔW of each dust core after keeping it at a high temperature and a high humidity (80° C., 95% RH) for 1000 hours.

$$\Delta W = \frac{W_{2/100k}\text{ (Heat-Treated)} - W_{2/100k}\text{ (Not Treated)}}{W_{2/100k}\text{ (Not Treated)}}$$

TABLE 5

| No.* | Composition (at %) | Corrosion Resistance | ΔW |
|---|---|---|---|
| 1 | $(Fe_{0.98}Co_{0.02})_{70}Cu_1Si_{14}B_9Nb_3Cr_3$ | Excellent | 1.00 |
| 2 | $Fe_{70}Cu_1Si_{14}B_9Nb_3Ru_3$ | Excellent | 1.00 |
| 3 | $Fe_{69}Cu_1Si_{15}B_9Ta_3Ti_3$ | Good | 1.02 |
| 4 | $(Fe_{0.99}Ni_{0.01})_{70}Cu_1Si_{14}B_9Zr_3Rh_3$ | Excellent | 1.00 |
| 5 | $Fe_{70}Cu_1Si_{15}B_8Hf_3Pd_3$ | Excellent | 1.00 |
| 6 | $Fe_{69}Cu_1Si_{15}B_7Mo_5Os_3$ | Excellent | 1.00 |
| 7 | $Fe_{66.5}Cu_{1.5}Si_{14}B_{10}W_5Ir_3$ | Excellent | 1.01 |
| 8 | $Fe_{69}Cu_1Si_{13}B_9Nb_5Pt_3$ | Excellent | 1.00 |
| 9 | $Fe_{71}Cu_1Si_{13}B_9Nb_3Au_3$ | Excellent | 1.00 |
| 10 | $Fe_{71}Cu_1Si_{13}B_9Nb_3V_3$ | Good | 1.03 |
| 11 | $Fe_{70}Cu_1Si_{13}B_9Nb_3Cr_1Ru_3$ | Excellent | 1.00 |
| 12 | $Fe_{68}Cu_1Si_{14}B_{10}Nb_3Cr_1Ti_1Ru_2$ | Excellent | 1.01 |
| 13 | $Fe_{69}Cu_1Si_{14}B_9Nb_3Ti_1Ru_1Rh_2$ | Excellent | 1.00 |
| 14 | $Fe_{72}Cu_1Si_{15}B_6Nb_3Ru_2Rh_1$ | Excellent | 1.00 |
| 15 | $Fe_{73}Cu_{1.5}Nb_3Si_{13.5}B_9$ | Fair | 1.05 |
| 16 | $(Co_{0.94}Fe_{0.06})_{75}Si_{15}B_{10}$ Amorphous | Good | 1.68 |

Note
*Sample No. 16 is Comparative Example.

It is-clear from Table 5 that the Fe-base soft magnetic alloy dust cores of the present invention containing one or more of Ru, Rh, Pd, Os, Ir, Pt, Au, Cr, Ti and V had excellent corrosion resistance, small core loss change at high temperature and high humidity. Thus, they can be used in severe environment.

EXAMPLE 16

A melt having the composition (by atomic %) of 1% Cu, 13.8% Si, 8.9% B, 3.2% Nb and balance substantially Fe was formed into a ribbon of 10mm in width and 18 μm in thickness by a single roll method. The X-ray diffraction of this ribbon showed a halo pattern peculiar to an amorphous alloy. A transmission electron photomicrograph (magnification: 300,000) of this ribbon shows that the resulting ribbon was almost completely amorphous.

Next, this amorphous ribbon was heat-treated in a nitrogen gas atmosphere at 570° C. for one hour. It is evident from a transmission electron photomicrograph (magnification: 300,000) of the heat-treated ribbon that most the alloy structure of the ribbon after the heat treatment consisted of fine crystalline particles. The crystalline particles had an average particle size of about 100 Å.

In view of the fact that the crystalline particles become coarse when there is no Cu, the addition of both Cu and Nb, etc. has a remarkable effect of making the crystalline particles fine in the alloy structure.

The heat-treated ribbon was pulverized to 48 mesh or smaller by a vibration mill, and then formed into a dust core of 20 mm in outer diameter, 12 mm in inner diameter and 6 mm in thickness in the same manner as in Example 10.

On the other hand, the same amorphous alloy ribbon was subjected to a conventional heat treatment (400° C.×1 hour) to keep its amorphous state and then formed into a dust core of the same shape in the same manner as above.

For both dust cores, a core loss was measured at a maximum wave height of a magnetic flux density Bm=2kG and a frequency of 100kHz. As a result, the core loss $W_{2/100k}$ was 5500$_{mW/cc}$ for the dust core subjected to the conventional heat treatment and 930$_{mW/cc}$ for that of the present invention. This means that because fine crystalline particles are uniformly formed in the alloy structure according to the present invention, the core loss decreases extremely.

EXAMPLE 17

Under the same conditions as in Example 16, Fe-base alloy dust cores having the compositions shown in Table 6 were produced. For those to which the heat treatment of the present invention was conducted in the state of a ribbon and those to which the conventional heat treatment was conducted to keep their amorphous state, a core loss $W_{2/100k}$ was measured. The results are shown in Table 6. The comparison of the data shows that the heat treatment of the present invention can provide the alloy with a low core loss.

TABLE 6

| No. | Composition (at %) | Heat Treatment of Present Invention Core Loss $W_{2/100K}$ (mW/cc) | Conventional Heat Treatment Core Loss $W_{2/100K}$ (mW/cc) |
|---|---|---|---|
| 1 | $Fe_{73}Cu_1Si_{13}B_9Nb_3C_1$ | 1560 | 5100 |
| 2 | $Fe_{73}Cu_1Si_{13}B_9Nb_3Ge_1$ | 1490 | 4700 |
| 3 | $Fe_{73}Cu_1Si_{13}B_9Nb_3P_1$ | 1510 | 5500 |
| 4 | $Fe_{73}Cu_1Si_{13}B_9Nb_3Ga_1$ | 1460 | 5200 |
| 5 | $Fe_{73}Cu_1Si_{13}B_9Nb_3Sb_1$ | 1620 | 6100 |
| 6 | $Fe_{73}Cu_1Si_{13}B_9Nb_3As_1$ | 1570 | 6200 |
| 7 | $Fe_{71}Cu_1Si_{13}B_8Mo_5C_2$ | 1700 | 4900 |
| 8 | $Fe_{70}Cu_1Si_{14}B_6Mo_3Cr_1C_5$ | 1880 | 5300 |
| 9 | $(Fe_{0.95}Co_{0.05})_{70}Cu_1Si_{13}B_9Nb_5Al_1C_1$ | 1920 | 6000 |
| 10 | $(Fe_{0.98}Ni_{0.02})_{70}Cu_1Si_{13}B_9W_5V_1Ge_1$ | 1850 | 5500 |
| 11 | $Fe_{68.5}Cu_{1.5}Si_{13}B_9Nb_5Ru_1C_2$ | 1570 | 6100 |
| 12 | $Fe_{70}Cu_1Si_{14}B_8Ta_3Cr_1Ru_2C_1$ | 1650 | 5400 |
| 13 | $Fe_{70}Cu_1Si_{14}B_9Nb_5Be_1$ | 1380 | 6400 |
| 14 | $Fe_{68}Cu_1Si_{15}B_9Nb_5Mn_1Be_1$ | 1400 | 5600 |
| 15 | $Fe_{69}Cu_2Si_{14}B_8Zr_5Rh_1In_1$ | 1540 | 5600 |
| 16 | $Fe_{71}Cu_2Si_{13}B_7Hf_5Au_1C_1$ | 1570 | 6800 |
| 17 | $Fe_{66}Cu_1Si_{16}B_{10}Mo_5Sc_1Ge_1$ | 1400 | 5900 |
| 18 | $Fe_{67.5}Cu_{0.5}Si_{14}B_{11}Nb_5Y_1P_1$ | 1550 | 6200 |
| 19 | $Fe_{67}Cu_1Si_{13}B_{12}Nb_5La_1Ga_1$ | 2110 | 6500 |
| 20 | $(Fe_{0.95}Ni_{0.05})_{70}Cu_1Si_{13}B_9Nb_5Sm_1Sb_1$ | 2050 | 7000 |
| 21 | $(Fe_{0.92}Co_{0.08})_{70}Cu_1Si_{13}B_9Nb_5Zn_1As_1$ | 1890 | 6300 |
| 22 | $(Fe_{0.96}Ni_{0.02}Co_{0.02})_{70}Cu_1Si_{13}B_9Nb_5Sn_1In_1$ | 1890 | 5800 |
| 23 | $Fe_{69}Cu_1Si_{13}B_9Mo_5Re_1C_2$ | 1640 | 5900 |
| 24 | $Fe_{69}Cu_1Si_{13}B_9Mo_5Ce_1C_2$ | 2010 | 6600 |
| 25 | $Fe_{69}Cu_1Si_{13}B_9W_5Pr_1C_2$ | 2020 | 6200 |
| 26 | $Fe_{69}Cu_1Si_{13}B_9W_5Nd_1C_2$ | 1860 | 5500 |
| 27 | $Fe_{68}Cu_1Si_{14}B_9Ta_5Gd_1C_2$ | 2040 | 6700 |
| 28 | $Fe_{69}Cu_1Si_{13}B_9Nb_5Tb_1C_2$ | 2040 | 6300 |
| 29 | $Fe_{70}Cu_1Si_{14}B_8Nb_5Dy_1Ge_1$ | 2010 | 5800 |
| 30 | $Fe_{72}Cu_1Si_{13}B_7Nb_5Pd_1Ge_1$ | 1830 | 6600 |
| 31 | $Fe_{70}Cu_1Si_{13}B_9Nb_5Ir_1P_1$ | 1900 | 6700 |
| 32 | $Fe_{70}Cu_1Si_{13}B_9Nb_5Os_1Ga_1$ | 1360 | 5800 |
| 33 | $Fe_{71}Cu_1Si_{14}B_9Ta_3Cr_1C_1$ | 1600 | 5200 |
| 34 | $Fe_{67}Cu_1Si_{15}B_6Zr_5V_1C_5$ | 1590 | 6500 |
| 35 | $Fe_{63}Cu_1Si_{16}B_5Hf_5Cr_2C_6$ | 1680 | 7100 |
| 36 | $Fe_{68}Cu_1Si_{14}B_9Mo_4Ru_3C_1$ | 1380 | 5400 |
| 37 | $Fe_{70}Cu_1Si_{14}B_9Mo_3Ti_1Ru_1C_1$ | 1400 | 6200 |
| 38 | $Fe_{67}Cu_1Si_{14}B_9Nb_6Rh_2C_1$ | 1580 | 5600 |
| 39 | $Fe_{73.5}Cu_1Nb_3Si_{13.5}B_9$ | 1630 | 5300 |

EXAMPLE 18

Amorphous alloy ribbons having the composition of $Fe_{73-x}Cu_xSi_{13}B_9Nb_3Cr_1C_1$ (x=0, 0.5, 1.0 and 1.5) were formed into dust cores of 20 mm in outer diameter, 12 mm in inner diameter and 6 mm in thickness in the same manner as in Example 10. Each dust core was heat-treated at various temperatures for 1 hour. For each dust core, a core loss $W_{2/100k}$ at 2kG and 100kHz was measured. The results are shown in FIG. 6.

Incidentally, the crystallization temperature Tx of the amorphous alloy for each dust core was measured by a differential scanning calorimeter (DSC) at a heating rate of 10° C./min. As a result, it was 580° C. for x=0 and 505° C. for x=0.5, 1.0 and 1.5.

Figure 6:
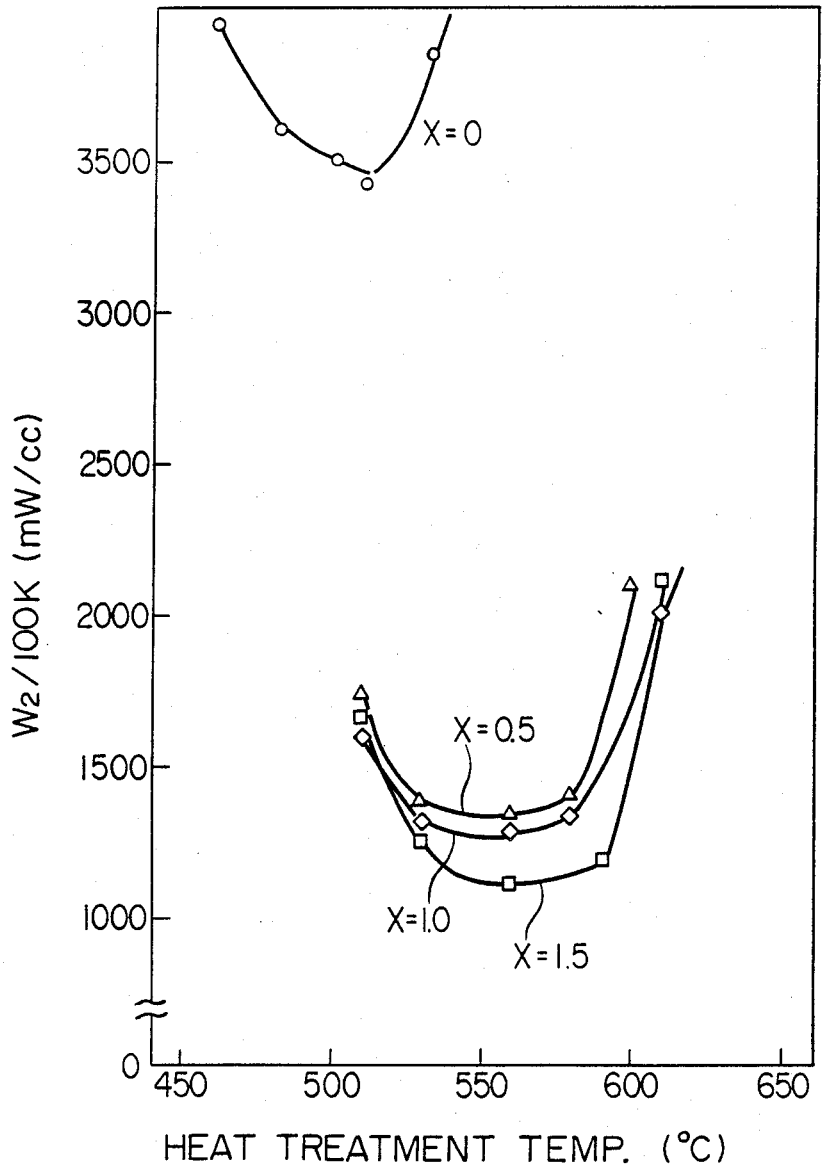
FIG. 6 is a graph showing the relations between heat treatment temperature and a core loss with respect to the Fe-base solf magnetic alloy of Example 19.

As is clear form FIG. 6, when the Cu content x was 0, the core loss $W_{2/100k}$ was extremely large. The addition of Cu leads to the decrease in a core loss. Thus, the proper heat treatment temperature range is 540–580° C. much higher than that for an alloy containing no Cu. This temperature is higher than the crystallization temperature Tx measured by DSC at a heating rate of 10° C./min.

As a result of a transmission electron microscopic observation, it was confirmed that the dust core produced from the Fe-base soft magnetic alloy containing Cu according to the present invention contained fine crystalline particles in an amount of 50% or more.

EXAMPLE 19

Alloy powder each having the composition shown in Table 7 was produced by a water atomizing method, and it was classified by a sieve to obtain powder of 48 mesh or smaller. The powder thus formed showed a halo pattern in an X-ray diffraction, which is peculiar to an amorphous alloy.

Next, the powder was mixed with 7 wt% of a heat-resistant varnish consisting of modified alkyl silicate and heated to about 530° C. at a heating rate of 50° C./min while compressing, to conduct hot pressing at such temperature for 30 minutes. Thus, dust cores of 20 mm in outer diameter, 12 mm in inner diameter and 6 mm in thickness were obtained.

The X-ray diffraction of the dust core revealed that it showed crystal peaks, meaning that it was finely crystallized.

Table 7 shows effective permeability $\mu e_{1k}$ at 1kHz for each dust core.

TABLE 7

| No.* | Composition (at %) | $\mu$ e1k |
|---|---|---|
| 1 | $Fe_{73.5}Cu_1Nb_3Si_{17.5}B_5$ | 1700 |
| 2 | $Fe_{72.5}Cu_1Nb_3Si_{18.5}B_5$ | 1600 |
| 3 | $Fe_{71}Cu_{1.5}Nb_5Si_{16.5}B_6$ | 1800 |
| 4 | $Fe_{73}Cu_1Mo_5Si_{16}B_5$ | 1500 |
| 5 | $Fe_{73}Cu_1W_5Si_{15}B_6$ | 1400 |
| 6 | $Fe_{73}Cu_1Nb_3Cr_1Si_{14}B_8$ | 1700 |
| 7 | $Fe_{74}Cu_1Ta_3Si_{14}B_8$ | 1600 |
| 8 | $Fe_{71}Cu_1Ti_5Si_{17}B_5Ge_1$ | 1500 |
| 9 | $Fe_{71}Cu_1Zr_5Si_{15}B_7C_1$ | 1400 |
| 10 | $Fe_{72}Cu_1Hf_5Si_{15}B_6P_1$ | 1500 |
| 11 | Fe—Si—Al Alloy | 100 |

Note
*Sample No. 11 is Comparative Example.

The Fe-base soft magnetic alloy dust cores of the present invention had saturation magnetic flux densities of 10kG or more and $\mu e_{1k}$ higher than 1000. Therefore, they are highly suitable for noise filters, choke coils, etc.

EXAMPLE 20

Amorphous alloy powder having the composition of $Fe_{73.5}Cy_1Nb_3Si_{16.5}B_6$ in the form of a flake was produced by a cavitation method.

Next, this powder was mixed with water glass, aluminum phosphate, powdery acetone and methanol and compressed by die at 450° C. under pressure of 15 T/cm$^2$ for 30 minutes to produce a dust core of 21 mm in outer diameter 12 mm in inner diameter and 8 mm in height. This dust core was then heat-treated at 530° C. for 30 minutes. After measuring its magnetic properties, its X-ray diffraction was measured. As a result, it was confirmed that the dust core consisted substantially of a crystalline phase.

Figure 7:
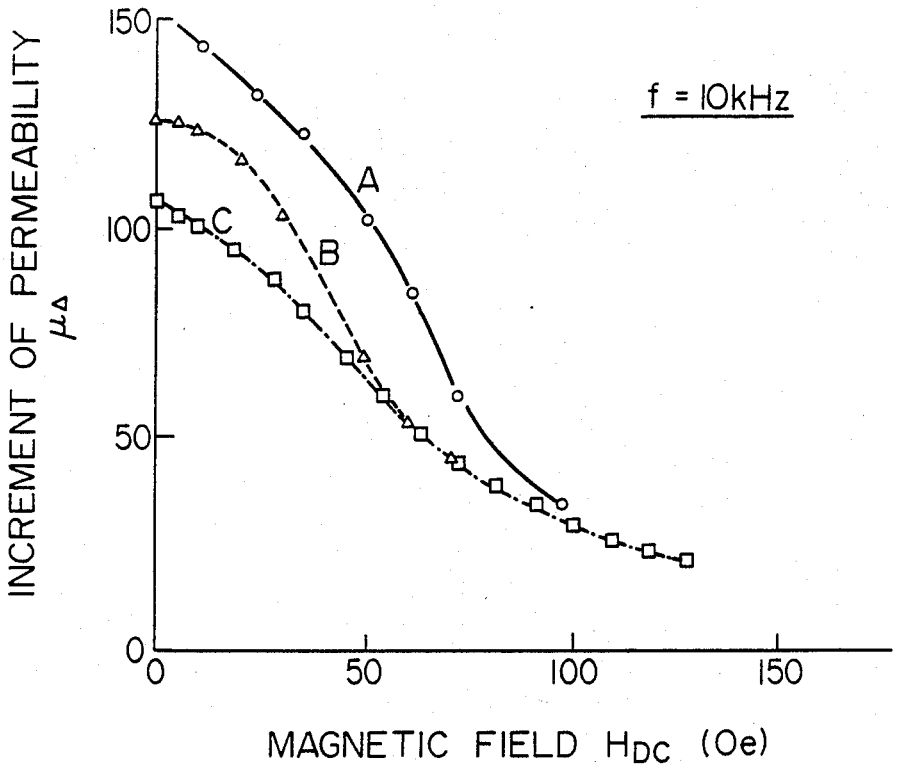
FIG. 7 is a graph showing the relations between incremental permeability and magnetic field strength with respect to the Fe-base soft magnetic alloy of Example 21.

FIG. 7 shows the increments of permeability by applying a DC magnetic field to the dust core (A) of the present invention, an Mo Permalloy dust core (B) and an Fe-Si-Al dust core (C), respectively.

The dust core (A) of the present invention showed better permeability characteristics when a DC magnetic field was applied than the conventional dust cores. Accordingly, it is suitable for smoothing chokes for switching power supplies, etc.

EXAMPLE 21

An amorphous alloy ribbon having the composition of $Fe_{71.5}Cu_1Nb_5Si15.5B_7$ with a width of 5 mm and a thickness of 15$\mu$m was produced, and it was heated at 450° C. for 1 hour. After cooling down to room temperature, it was pulverized to powder of 48 mesh or smaller by a vibration mill for 1 hour.

Next, this powder was mixed with water glass, aluminum phosphate, powdery acetone and methanol and compressed by die at 500° C. under pressure of 15 T/cm$^2$ for 30 minutes to produce a dust core of 21 mm in outer diameter, 12 mm in inner diameter and 8 mm in height. This dust core was then heat-treated at 570° C. for 30 minutes.

Figure 8:
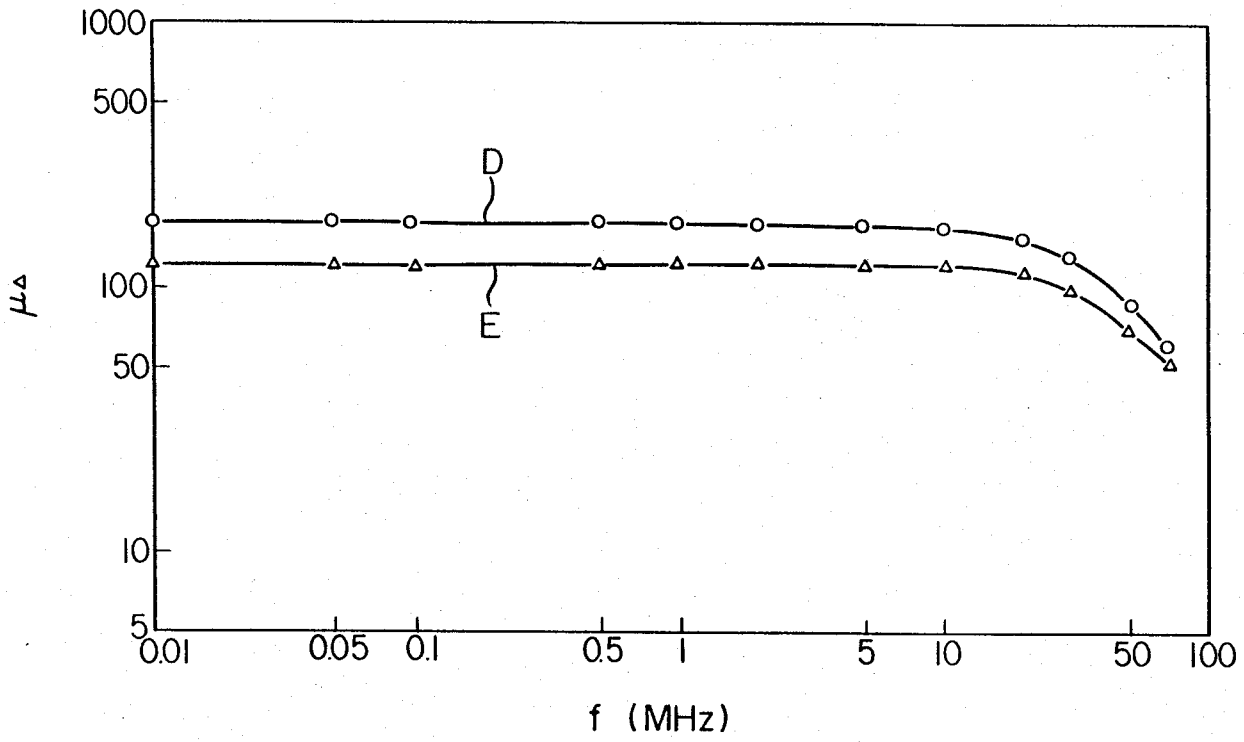
FIG. 8 is a graph showing the relations between effective permeability and frequency with respect to the Fe-base soft magnetic alloy of Example 22.

Next, this dust core was coated with an epoxy resin and then measured with respect to the dependency of effective permeability $\mu e$ on frequency. As a result of an X-ray diffraction observation, crystal peaks were observed, meaning that the alloy was almost completely crystallized. The results are shown by (D) in FIG. 8. For comparison, the effective permeability of an Mo Permalloy dust core (E) was also shown.

The dust core of the present invention showed better frequency characteristics of effective permeability than the conventional Mo Permalloy dust core. Accordingly, it is suitable for various inductors used at high frequency.

The present invention has been described by the above Examples, but it should be noted that any modifications can be made unless they deviate from the scope of the present invention defined by the claims attached hereto.

What is claimed is:

1. Fe-base soft magnetic alloy powder having the composition represented by the general formula:

$$(Fe_{1-a}M_a)_{100-x-y-z-\alpha-\beta-\gamma}Cu_xSi_yB_zM'_\alpha M''_\beta X_\gamma$$

wherein M is Co and/or Ni, ' is at least one element selected from the group consisting of Nb, W" Ta, Zr, Hf, Ti and Mo, M" is at least one element selected from the group consisting of V, Cr, Mn, A±, elements in the platinum group, Sc, Y, rare earth elements, Au, Zn, Sn and Re, X is at least one element selected from the group consisting of C, Ge, P, Ga, Sb, In, Be and As, and a, x, y, z, $\alpha$, $\beta$ and $\gamma$ respectively satisfy $0<a<0.5$, $0.1<x<3$, $0<y=<30$, $0<z<25$, $0<y+z<35$, $0.1<\alpha<30$, $0<\beta<10$ and $0<\gamma<10$, at least 50% of the alloy structure being fine crystalline particles having an average particle size of 500 Å or less.

2. The Fe-base soft magnetic alloy powder according to claim 1, wherein said a, x, y, z, $\alpha$, $\beta$ and $\gamma$ respectively satisfy $0<a<0.3$, $0.5<x<2$, $10<y<25$, $3\leqq z<12$, $18\leqq +z<28$, $2<\alpha<8$, $\beta<8$ and $\gamma<5$.

3. The Fe-base soft magnetic alloy powder according to claim 1, wherein said crystalline particles are substantially composed of an Fe solid solution having a bcc structure.

4. The Fe-base soft magnetic alloy powder according to claim 1, wherein the balance of said alloy structure is substantially amorphous.

5. The Fe-base soft magnetic alloy powder according to claim 1, wherein said alloy structure substantially consists of fine crystalline particles.

6. The Fe-base soft magnetic alloy powder according to claim 1, wherein said powder is in the form of a fine flake whose thickness is less than 100 μm and substantially uniform, and said powder has a particle size smaller than 4 mesh.

7. The Fe-base soft magnetic alloy powder according to claim 6, wherein said particle size is smaller than 10 mesh.

8. The Fe-base soft magnetic alloy powder according to claim 1, wherein said powder is substantially in the form of a sphere whose particle size is 200 μm or less when measured by its maximum size.

9. The Fe-base soft magnetic alloy powder according to claim 1, wherein said powder has an irregular shape having a maximum size less than 2 mm.

10. An Fe-base soft magnetic alloy dust core composed of compressed Fe-base soft magnetic alloy fine powder, said Fe-base soft magnetic alloy having the composition represented by the general formula:

$$(Fe_{1-a}M_a)_{100-x-y-z-\alpha-\beta-\gamma}Cu_xSi_yB_zM'_\alpha M''_\beta M_\gamma$$

wherein M is Co and/or Ni, M' is at least one element selected from the group consisting of Nb, W, Ta, Zr, Hf, Ti and Mo, M'' is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As, and a, x, y, z, α, β and Y respectively satisfy $0<a<0.5$, $0.1<x<3$, $0<y<30$, $0<z<25$, $0<y+z<35$, $0.1<\alpha<30$, $0<\beta<10$ and $0<\gamma<10$, at least 50% of the alloy structure being fine crystalline particles having an average particle size of 500 Å or less.

11. The Fe-base soft magnetic alloy dust core according to claim 10, wherein said a, x, y, z, α, β and γ respectively satisfy $0<a<0.3$, $0.5<x<2$, $10<y<25=-=3<=z<1=12$, $2\gamma+z<28$, $2<c<8$, $\beta<8$ and $\gamma<10$.

12. The Fe-base soft magnetic alloy dust core according to claim 10, wherein the balance of said alloy structure is substantially amorphous.

13. The Fe-base soft magnetic alloy dust core according to claim 10, wherein said alloy structure substantially consists of fine crystalline particles.

14. The Fe-base soft magnetic alloy dust core according to claim 10, wherein said ' is Nb.

15. The Fe-base soft magnetic alloy dust core according to claim 10, wherein M'' is at least one element selected from the group consisting of Ru, Ph, Pd, Os, Ir, Pt, Au, Cr, and V.

* * * * *

UNITED STATES PATENT AND TRADEMARK OFFICE

CERTIFICATE OF CORRECTION

PATENT NO. : 4,985,089

DATED : January 15, 1991

INVENTOR(S) : Yoshihito Yoshizawa et al

It is certified that error appears in the above-identified patent and that said Letters Patent is hereby corrected as shown below:

Column 20, line 45 (Claim 1, line 4), after "Ni,", insert -- M --;

Column 20, line 46 (Claim 1, line 5), delete " W" " and insert --W,--;

Column 20, line 48 (Claim 1, line 7), delete "A±" and insert --Al--;

Column 20, line 52 (Claim 1, line 11), "0 < a < 0.5" should be --$0 \leq a \leq 0.5$--;

Column 20, line 53 (Claim 1, line 12), delete the entire line and insert therefor:
--$0.1 \leq x \leq 3$, $0 \leq y \leq 30$, $0 \leq z \leq 25$, $0 \leq y+z \leq 35$--;

Column 20, line 54 (Claim 1, line 13), delete the entire line and insert therefor:
--$0.1 \leq \alpha \leq 30$, $0 \leq \beta \leq 10$ and $0 \leq \gamma \leq 10$, at least 50% of--.

Column 20, line 59 (Claim 2, line 3), should read as follows:
--tively satisfy $0 \leq \alpha \leq 0.3$, $0.5 \leq x \leq 2$, $10 \leq y \leq 25$,--;

Column 20, line 60 (Claim 2, line 4), should read as follows:
--$3 \leq z \leq 12$, $18 \leq y+z \leq 28$, $2 \leq \alpha \leq 8$, $\beta \leq 8$ and $\gamma \leq 10$.--.

Column 22, line 5 (Claim 10, line 13), "Y" should be --$\gamma$--;

Column 22, line 5, (Claim 10, line 13), "0 < a < 0.5" should be --$0 \leq a \leq 0.5$--;

Column 22, line 6 (Claim 10, line 14), all of the "<" symbols should be --$\leq$--;

Column 22, line 7 (Claim 10, line 15), all of the "<" symbols should be --$\leq$--.

UNITED STATES PATENT AND TRADEMARK OFFICE

CERTIFICATE OF CORRECTION

PATENT NO. : 4,985,089

DATED : January 15, 1991

INVENTOR(S) : Yoshihito Yoshizawa et al

It is certified that error appears in the above-identified patent and that said Letters Patent is hereby corrected as shown below:

Column 22, lines 13 and 14 (Claim 11, lines 3 and 4) should read as follows:
--spectively satisfy $0 \leq a \leq 0.3$, $0.5 \leq x \leq 2$, $10 \leq y \leq 25$, $3 \leq z \leq 12$, $18 \leq y+z \leq 28$, $2 \leq \alpha \leq 8$, $\beta \leq 8$ and $\gamma \leq 10$.--.

Column 22, line 22 (Claim 14, line 2), after "said", insert --M--.

Column 22, line 25 (Claim 15, line 3), "Ph" should be --Rh--.

Signed and Sealed this

Third Day of August, 1993

*Attest:*

*Attesting Officer*

Michael K. Kirk

MICHAEL K. KIRK

*Acting Commissioner of Patents and Trademarks*